US006237343B1

(12) United States Patent
Butler

(10) Patent No.: US 6,237,343 B1
(45) Date of Patent: May 29, 2001

(54) COMBUSTION CHAMBER AND A METHOD OF OPERATION THEREOF

(75) Inventor: Philip D Butler, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/302,364

(22) Filed: Apr. 30, 1999

(30) Foreign Application Priority Data

May 2, 1998 (GB) ..... 9809371

(51) Int. Cl.[7] ..... F02G 3/00
(52) U.S. Cl. ..... 60/723
(58) Field of Search ..... 60/723, 39.06, 60/752

(56) References Cited

U.S. PATENT DOCUMENTS

| | | | | |
|---|---|---|---|---|
| 5,003,768 | | 4/1991 | Kappler . | |
| 5,235,804 | * | 8/1993 | Colket, III et al. | 60/723 |
| 5,297,515 | | 3/1994 | Gale . | |
| 5,452,574 | | 9/1995 | Cowell . | |
| 5,623,819 | * | 4/1997 | Bowker et al. | 60/723 |
| 6,105,360 | * | 8/2000 | Willis | 60/723 |

FOREIGN PATENT DOCUMENTS

| | | |
|---|---|---|
| 06886813 | 12/1995 | (EP) . |
| 0805309 | 11/1997 | (EP) . |
| 0810405 | 12/1997 | (EP) . |
| 1575427 | 9/1980 | (GB) . |

* cited by examiner

*Primary Examiner*—Charles G. Freay
(74) *Attorney, Agent, or Firm*—W. Warren Taltavull; Manelli Denison & Selter PLLC

(57) ABSTRACT

A gas turbine engine (10) combustion chamber (28) comprises a primary combustion zone (36) and a secondary combustion zone(40) in which lean mixtures of fuel and air are burned. Air is supplied to a first mixing duct (50) through a swirler (52). Air is supplied to an additional mixing duct (58) through a swirler (54) and hydrocarbon fuel is supplied to the additional mixing duct (58) through a swirler (66). The hydrocarbon fuel and air is mixed and reacted in a catalytic partial oxidation reaction zone (60) which produces a product gas comprising a mixture of hydrogen, carbon monoxide, carbon dioxide, water and unreacted hydrocarbon fuel. Additional hydrocarbon fuel is supplied from apertures (72) and is mixed with the product gas in a mixing chamber (68) and this mixture is supplied to the first mixing duct (50) and mixes with the air. The first mixing duct (50) supplies a lean mixture of fuel into the primary combustion zone (36). The arrangement enables the combustion chamber (28) to operate with more stability or at leaner fuel to air ratios.

18 Claims, 2 Drawing Sheets

COMBUSTION CHAMBER AND A METHOD OF OPERATION THEREOF

FIELD OF THE INVENTION

The present invention relates generally to a combustion chamber and to a method of operating a combustion chamber, particularly to a gas turbine engine combustion chamber.

BACKGROUND OF THE INVENTION

In order to meet the emission level requirements, for industrial low emission gas turbine engines, staged combustion is required in order to minimise the quantity of the oxides of nitrogen (NOx) produced. The current emission level requirement, in some countries, is for less than 25 volumetric parts per million of NOx for an industrial gas turbine exhaust. One fundamental way to reduce emissions of nitrogen oxides is to reduce the combustion reaction temperature, and this requires premixing of the fuel and the combustion air before combustion occurs. The oxides of nitrogen (NOx) are commonly reduced by a method which uses two stages of fuel injection. Our UK patent no. GB1489339 discloses two stages of fuel injection. Our International patent application no. WO92/07221 discloses two and three stages of fuel injection. In staged combustion, all the stages of combustion seek to provide lean combustion and hence the low combustion temperatures required to minimise NOx. The term lean combustion means combustion of fuel in air where the fuel to air ratio is low, i.e. less than the stoichiometric ratio. In order to achieve the required low emissions of NOx and CO it is essential to mix the fuel and air uniformly.

The industrial gas turbine engine disclosed in our International patent application no. WO92/07221 uses a plurality of tubular combustion chambers, whose axes are arranged in generally radial directions. The inlets of the tubular combustion chambers are at their radially outer ends and transition ducts connect the outlets of the tubular combustion chambers with a row of nozzle guide vanes to discharge the hot gases axially into the turbine sections of the gas turbine engine. Each of the tubular combustion chambers has two coaxial radial flow swirlers which supply a mixture of fuel and air into a primary combustion zone. An annular secondary fuel and air mixing duct surrounds the primary combustion zone and supplies a mixture of fuel and air into a secondary combustion zone.

One problem associated with gas turbine engines is caused by pressure fluctuations in the air, or gas, flow through the gas turbine engine. Pressure fluctuations in the air, or gas, flow through the gas turbine engine may lead to severe damage, or failure, of components if the frequency of the pressure fluctuations coincides with the natural frequency of a vibration mode of one or more of the components. These pressure fluctuations may be amplified by the combustion process and under adverse conditions a resonant frequency may achieve sufficient amplitude to cause severe damage to the combustion chamber and the gas turbine engine.

It has been found that gas turbine engines which have lean combustion are particularly susceptible to this problem. Furthermore it has been found that as gas turbine engines which have lean combustion reduce emissions to lower levels by achieving more uniform mixing of the fuel and air, the amplitude of the resonant frequency becomes greater. It is believed that the amplification of the pressure fluctuations in the combustion chamber occurs because there is instability in the combustion process, there is a resonant cavity and the heat released by the burning of the fuel occurs at a position in the combustion chamber which corresponds to an antinode, or pressure peak, in the pressure fluctuations.

It is also known to provide gas turbine engine combustion chambers which have a plurality of catalytic reaction zones arranged in series to minimise nitrous oxide (NOx) emissions. One known arrangement is described in our European patent application EP0805309A, published Nov. 5, 1997 . In this arrangement a pilot injector is provided to burn some of the fuel to preheat a first catalytic reaction zone to its operating temperature. A main injector is positioned upstream of the first catalytic reaction zone to supply fuel to the first catalytic reaction zone. The second and subsequent catalytic reaction zones receive unburned fuel from the first catalytic reaction zone.

A problem with this arrangement is that it does not fit into the space available, and it requires staged fuelling between the catalytic reaction zones.

It is also known to provide gas turbine engine combustion chambers which have staged combustion using combustion of lean fuel and air mixtures in a catalytic reaction zone downstream of the last staged combustion zone and a homogeneous combustion zone downstream of the catalytic reaction zone to further reduce emissions of NOx. One known arrangement is described in our European patent application no. EP0810405A, published Dec. 3, 1997.

It is also known to provide catalytic partial oxidation in which a hydrocarbon fuel is mixed with air so that rich combustion occurs in contact with a catalyst to form a product gas which comprises a mixture of hydrogen, carbon monoxide, water, carbon dioxide and unreacted hydrocarbon fuel. The hydrocarbon fuel is burned with insufficient amounts of oxygen, for complete oxidation, such that it is only partially oxidised. The term rich combustion means combustion of fuel in air where the fuel to air ratio is high, i.e. greater than the stoichiometric ratio for complete oxidation. International patent application no. WO92/20963, published Nov. 26, 1992 describes a combustion system for a gas turbine where all the fuel is supplied to a catalytic partial oxidation reaction zone, the product gas of the catalytic partial oxidation reaction zone are mixed with air and supplied to a primary combustion zone and finally the products of the primary combustion zone are mixed with air and supplied to a secondary combustion zone. This arrangement reduces NOx emissions.

SUMMARY OF THE INVENTION

Accordingly the present invention seeks to provide a combustion chamber which operates with lean combustion and which operates with greater stability.

Accordingly the present invention provides a combustion chamber comprising at least one combustion zone defined by at least one peripheral wall, at least one first fuel and air mixing duct for supplying fuel and air respectively into the at least one combustion zone, means to supply air into the at least one first fuel and air mixing duct, at least one catalytic partial oxidation reaction zone, at least one additional fuel and air mixing duct for supplying fuel and air respectively into the at least one catalytic partial oxidation reaction zone, means to supply fuel and air into the at least one additional fuel and air mixing duct, the at least one catalytic partial oxidation reaction zone being arranged to produce a product gas comprising a mixture of hydrogen, carbon monoxide, water, carbon dioxide and unreacted fuel, means to supply additional fuel into the product gas produced by the at least one catalytic partial oxidation reaction zone, means to mix the additional fuel and the product gas produced by the at least one catalytic partial oxidation reaction zone, and means to supply the product gas and additional fuel into the at least one first fuel and air mixing duct such that the product gas and additional fuel mix with the air in the first fuel and air mixing duct before being supplied into the at least one combustion zone.

Preferably the combustion chamber comprises a primary combustion zone and a secondary combustion zone downstream of the primary combustion zone.

Preferably the at least one first fuel and air mixing duct is arranged to supply fuel and air into the primary combustion zone, and at least one second fuel and air mixing duct is arranged to supply fuel and air respectively to the secondary combustion zone.

Preferably the combustion chamber comprises a tertiary combustion chamber downstream of the secondary combustion zone.

Preferably at least one third fuel and air mixing duct is arranged to supply fuel and air to the tertiary combustion zone.

Preferably an air duct supplies air to the at least one first fuel and air mixing duct, the air duct having means to swirl the air.

Preferably the means to swirl the air comprises a radial flow swirler.

Preferably the at least one additional fuel and air mixing duct comprises an upstream end, means to supply air into the upstream end of the additional fuel and air mixing duct, the means to supply air into the at least one additional fuel and air mixing duct comprises means to swirl the air, means to supply fuel into the upstream end of the additional fuel and air mixing duct, the means to supply fuel into the at least one additional fuel and air mixing duct comprises means to swirl the fuel.

Preferably the means to swirl the air comprises a radial flow swirler and the means to swirl the fuel comprises a radial flow swirler.

Preferably the means to swirl the air and the means to swirl the fuel are arranged to swirl the air and fuel in opposite directions.

Preferably the means to mix the product gas produced by the catalytic partial oxidation reaction zone and the additional fuel comprises means to swirl the additional fuel into the product gas and a duct interconnecting with the first fuel and air mixing duct.

Preferably the combustion chamber is a tubular combustion chamber. Preferably the first fuel and air mixing duct is annular. Preferably the additional fuel and air mixing duct is annular. Preferably the catalytic partial oxidation reaction zone is annular. Preferably the means to supply the mixture of product gas and additional fuel into the at least one first fuel and air mixing duct comprises an annular duct.

Preferably the additional fuel and air mixing duct is arranged to supply the fuel and air in an axially upstream direction to the catalytic partial oxidation reaction zone, and the means to supply the mixture of product gas and additional fuel is arranged to supply the product gas and additional fuel in an axially downstream direction to the first fuel and air mixing duct.

The present invention also provides a method of operating a combustion chamber comprising mixing a hydrocarbon fuel with air to produce a rich mixture of hydrocarbon fuel and air, supplying the rich mixture of hydrocarbon fuel and air to a catalytic partial oxidation reaction zone, reacting the hydrocarbon fuel in the catalytic partial oxidation reaction zone to produce a product gas comprising hydrogen, carbon monoxide, carbon dioxide, water and unreacted hydrocarbon fuel, mixing the product gas with additional hydrocarbon fuel, mixing the mixture of product gas and additional hydrocarbon fuel with air to produce a lean mixture, supplying the lean mixture to a combustion zone, burning the product gas and additional hydrocarbon fuel in air in the combustion zone.

Preferably the method comprises supplying the products of the combustion zone into a further combustion zone, mixing hydrocarbon fuel with air to produce a lean mixture, supplying the lean mixture to the further combustion zone, and burning the hydrocarbon fuel in air in the further combustion zone. The mixture of product gas and additional hydrocarbon fuel may comprise up to 25 vol % hydrogen.

The high flammability of the hydrogen rich fuel enables more stable combustion of the premixed lean fuel and air mixture therefore potentially reducing the combustion generating noise. The hydrogen rich fuel enables stable combustion with leaner mixtures of fuel and air than conventional premixed lean combustion and therefore allows the peak combustion temperature and hence the emissions of NOx to be reduced. The hydrogen rich fuel also enables the carbon monoxide emissions to be reduced when operating at part powers. The proportion of fuel supplied to the catalytic partial oxidation reaction zone and the additional fuel supplied to the products of catalytic partial oxidation reaction zone may be varied to vary the hydrogen content in the fuel. This may provide an additional control parameter to control vibrations, or noise, of the combustion chamber and NOx emissions.

BRIEF DESCRIPTION OF THE DRAWINGS

The present invention will be more fully described by way of example with reference to the accompanying drawing, in which.

DETAILED DESCRIPTION OF THE INVENTION

Figure 1:
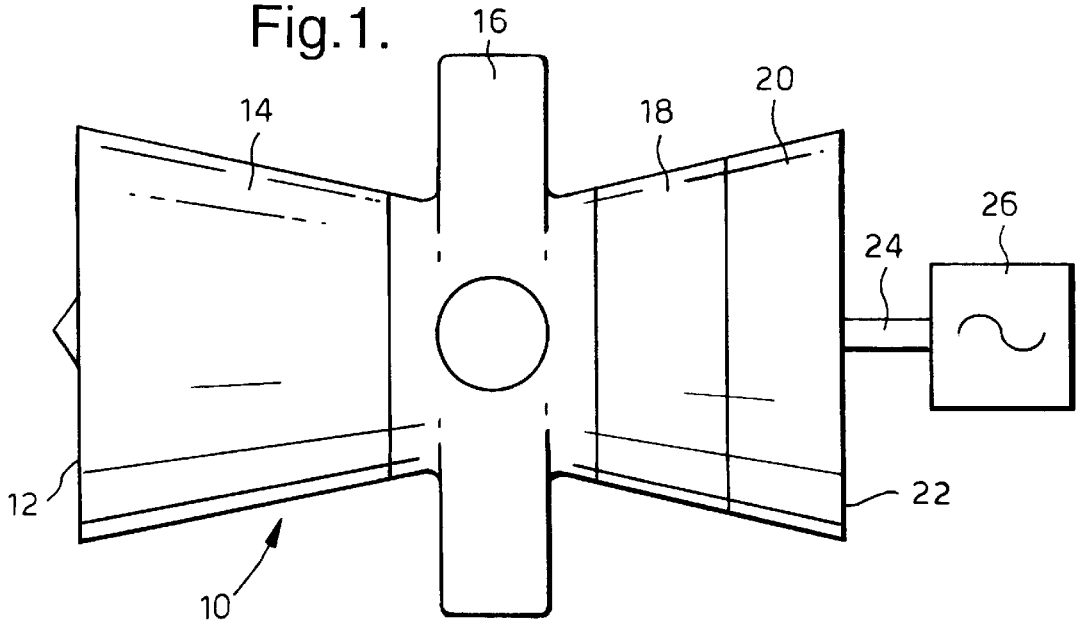
FIG. 1 is a view of a gas turbine engine having a combustion chamber according to the present invention.

An industrial gas turbine engine 10, shown in FIG. 1, comprises in axial flow series an inlet 12, a compressor section 14, a combustion chamber assembly 16, a turbine section 18, a power turbine section 20 and an exhaust 22. The turbine section 18 is arranged to drive the compressor section 14 via one or more shafts (not shown). The power turbine section 20 is arranged to drive an electrical generator 26 via a shaft 24. However, the power turbine section 20 may be arranged to provide drive for other purposes. The operation of the gas turbine engine is quite conventional and will not be discussed further.

Figure 2:
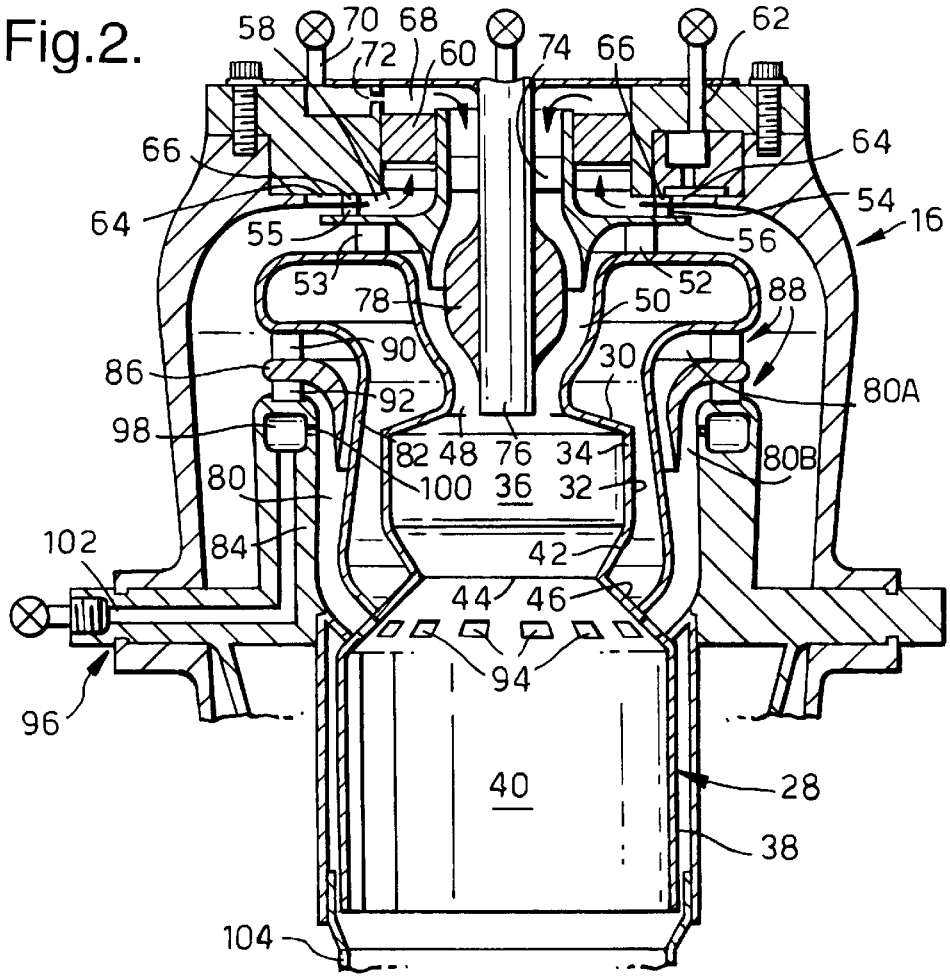
FIG. 2 is an enlarged longitudinal cross-sectional view through the combustion chamber shown in FIG. 1.

The combustion chamber assembly 16 is shown more clearly in FIG. 2. The combustion chamber assembly 16 comprises a plurality of, for example nine, equally circumferentially spaced tubular combustion chambers 28. The axes of the tubular combustion chambers 28 are arranged to extend in generally radial directions. The inlets of the tubular combustion chambers 28 are at their radially outermost ends and their outlet are at their radially innermost ends.

Each of the tubular combustion chambers 28 comprises an upstream wall 30 secured to the upstream end of an annular wall 32. A first, upstream, portion 34 of the annular wall 32 defines a primary combustion zone 36, a second, downstream, portion 38 of the annular wall 32 defines a secondary combustion zone 40. The downstream end of the first portion 34 has a frustoconical portion 42 which reduces in diameter to a throat 44. The second portion 38 of the annular wall 32 has a greater diameter than the first portion 34. A frustoconical portion 46 interconnects the throat 44 with the upstream end of the second portion 38 of the annular wall 32.

The upstream wall 30 of each tubular combustion chamber 28 has an aperture 48 to allow the supply of air and fuel into the primary combustion zone 36. A first fuel and air mixing duct 50 is arranged to supply a mixture of fuel and air through the aperture 48 into the primary combustion zone 36.

A first radial flow swirler 52 is arranged coaxially with the aperture 48 in the upstream wall 30 and a second radial flow swirler 54 is arranged coaxially with the aperture 48 in the upstream wall 30. The first radial flow swirler 52 is positioned axially downstream, with respect to the axis of the tubular combustion chamber 28, of the second radial flow swirler 54. The first radial flow swirler 52 and the second radial flow swirler 54 comprise a number of swirl vanes 53 and 55 respectively which are connected to and are separated by a common splitter 56. The first radial flow swirler 52 is arranged to supply air into the first fuel and air mixing duct 50. The first radial flow swirler 52 and the second radial flow swirler 54 are arranged such that they swirl the air in opposite directions.

The second radial flow swirler 54 is arranged to supply fuel into an additional fuel and air mixing duct 58. The additional fuel and air mixing duct 58 is arranged to supply a mixture of fuel and air to a catalytic partial oxidation reaction zone 60.

The catalytic partial oxidation reaction zone 60 is arranged coaxially with the axis of the tubular combustion chamber 28. The catalytic partial oxidation reaction zone 60 comprises a honeycomb structure suitable which is catalyst coated or comprises a catalyst, for example the catalytic partial oxidation zone may comprise a catalyst coated ceramic honeycomb monolith or a catalyst coated metallic honeycomb, or a ceramic honeycomb monolith containing catalyst. The honeycomb structure of the catalytic partial oxidation reaction zone comprises a plurality of passages separated by catalyst coated walls and is not limited to honeycomb structures. The catalyst may be platinum, palladium, rhodium, nickel, iron, cobalt or a mixture of any two or more of these or any other catalyst suitable for promoting partial oxidation.

A fuel pipe 62 is arranged to supply fuel to an annular fuel manifold 64 arranged coaxially with the axis of the tubular combustion chamber 28. The annular fuel manifold 64 is arranged to supply fuel into the additional fuel and air mixing duct 58 through a radial flow swirler 66. The radial flow swirlers 56 and 66 are arranged to swirl the air and fuel in opposite directions. The catalytic partial oxidation reaction zone is interconnected to an annular mixing chamber 68. A pipe 70 is arranged to supply additional fuel through apertures 72 into the annular mixing chamber 68. The additional fuel and the reaction products from the catalytic partial oxidation reaction zone 60 are mixed together and an axial flow swirler 74 is provided to increase mixing. The additional fuel and reaction products from the catalytic partial oxidation reaction zone 60 are supplied to the first fuel and air mixing duct 50.

A central pilot injector 76 is provided at the upstream end of each tubular combustion chamber 28. Each central pilot injector 76 is arranged coaxially, with and on the axis of, the respective aperture 48. Each central pilot injector 76 is arranged to supply fuel into the primary combustion zone 36. The central pilot injector 76 extends coaxially through the catalytic partial oxidation reaction zone 60 and defines the radially inner extremity of the annular mixing chamber 68 and also the radially inner extremity of the first fuel and air mixing duct 50. The central fuel injector 76 may have a shaped surface 78 downstream of the axial flow swirler 74 and upstream of the aperture 48.

An annular secondary fuel and air mixing duct 80 is provided for each of the tubular combustion chambers 28. Each secondary fuel and air mixing duct 80 is arranged coaxially around the primary combustion zone 36. Each of the secondary fuel and air mixing ducts 80 is defined between a second annular wall 82 and a third annular wall 84. The second annular wall 82 defines the radially inner extremity of the secondary fuel and air mixing duct 80 and the third annular wall 84 defines the radially outer extremity of the secondary fuel and air mixing duct 80. An annular splitter 86 is provided in the secondary fuel and air mixing duct 80 at the upstream end of the secondary fuel and air mixing duct 80.

Each secondary fuel and air mixing duct 80 has a secondary air intake 88 defined axially between the upstream end of the second annular wall 82 and the upstream end of the splitter 86 and between the upstream end of the splitter 86 and the upstream end of the third annular wall 84. The splitter 86 is supported from the second annular wall 82 and the third annular wall 84 by the vanes of two radial flow swirlers 90 and 92 respectively. The radial flow swirlers 90 and 92 are arranged to swirl the air flow through the secondary fuel and air mixing duct 80 in opposite directions.

At the downstream end of each secondary fuel and air mixing duct 80, the second and third annular walls 82 and 84 respectively are secured to the frustoconical portion 46 and the frustoconical portion 46 is provided with a plurality of equi-circumferentially spaced apertures 94. The apertures 94 are arranged to direct the fuel and air mixture into the secondary combustion zone 40 in the tubular combustion chamber 28, in a downstream direction towards the axis of the tubular combustion chamber 28. The apertures 94 may be circular or slots or any other suitable shape and are of equal flow area.

Each secondary fuel and air mixing duct 80 reduces gradually in cross-sectional area from the intake 88 at its upstream end to the apertures 94 at its downstream end. The second and third annular walls 82 and 84 of the secondary fuel and air mixing duct 80 are shaped to produce an aerodynamically smooth duct. The shape of the secondary fuel and air mixing duct 80 therefore produces an accelerating flow through the duct 80 without any regions where recirculating flows may occur.

A plurality of secondary fuel systems 96 are provided, to supply fuel to the secondary fuel and air mixing duct 80 of each of the tubular combustion chambers 28. The secondary fuel system 96 for each tubular combustion chamber 28 comprises an annular secondary fuel manifold 98 arranged coaxially with the tubular combustion chamber 28 within the third annular wall 84. Each secondary fuel manifold 98 has a plurality of apertures 100 to direct the fuel substantially radially inwardly into the secondary fuel and air mixing duct 80, more specifically the apertures 100 direct the fuel to the passage 80B defined between the splitter 86 and the third annular wall 84 downstream of the radial flow swirler 92. The secondary fuel manifold 98 is supplied with fuel by a fuel pipe 102.

A plurality of transition ducts 104 are provided in the combustion chamber assembly 16, and the upstream end of each transition duct has a circular cross-section. The upstream end of each transition duct 104 is located coaxially with the downstream end of a corresponding one of the tubular combustion chambers 28, and each of the transition ducts 104 connects and seals with an angular section of the nozzle guide vanes. The downstream end of each tubular combustion chamber 28 and the upstream end of the corresponding transition duct 104 are located in a support structure (not shown).

In operation a portion of the primary, hydrocarbon, fuel is supplied through pipe 62, annular fuel manifold 64 and radial flow swirler 66 into the additional fuel and air mixing duct 58. The primary, hydrocarbon, fuel mixes with the air supplied from the radial flow swirler 56 to produce a rich mixture of fuel and air, i.e. the fuel to air ratio is greater than the stoichiometric ratio. This mixture of hydrocarbon fuel and air flows from the additional fuel and air mixing duct 58 into the catalytic partial oxidation reaction zone 60. The hydrocarbon fuel is partially oxidised by the air in the catalytic partial oxidation reaction zone 60 in the presence of the catalyst to produce a reaction product gas which comprises a mixture of hydrogen, carbon monoxide, water, carbon dioxide and perhaps some unburned hydrocarbon fuel. The mixture of hydrogen, carbon monoxide, water, carbon dioxide and unburned hydrocarbon fuel then flows from the catalytic partial oxidation reaction zone 60 to the mixing chamber 68.

Additional primary, hydrocarbon, fuel is supplied through pipe 70 and apertures 72 into the mixing chamber 68 to mix with the reaction product gas comprising hydrogen, carbon monoxide, water, carbon dioxide and unburned hydrocarbon fuel, from the catalytic partial oxidation reaction zone 60 and results in a fuel comprising up to 25 vol % hydrogen. The additional primary fuel also cools the hydrogen, carbon monoxide, water, carbon monoxide and unburned hydrocarbon fuel. The mixing process is aided by the axial flow swirler 74. This fuel, containing up to 25vol % hydrogen, is then supplied into the first fuel and air mixing duct 50. This fuel is thoroughly mixed with the air supplied through the radial flow swirler 52 to produce a lean mixture of fuel and air, i.e. the fuel to air ratio is less than the stoichiometric ratio.

This lean mixture of fuel and air is then supplied from the first fuel and air mixing duct 50 through the aperture 48 into the primary combustion zone 36. The fuel is then burned in the air in the primary combustion zone 36.

The products of combustion from the primary combustion zone 36 flow into the secondary combustion zone 40. A secondary, hydrocarbon, fuel is supplied through pipe 102, annular fuel manifold 98 and apertures 100 into the secondary fuel and air mixing duct 80. The fuel is thoroughly mixed with the air supplied through the radial flow swirlers 90 and 92 to produce a lean mixture of fuel and air. The lean mixture of fuel and air is then supplied from the secondary fuel and air mixing duct 80 through the apertures 94 into the secondary combustion zone 40. The fuel is then burned in the air in the secondary combustion zone 40.

It is to be noted that the fuel and air in the additional fuel and air mixing duct 58 flows in an axial upstream direction away from the aperture 48 in the upstream wall 30 of the tubular combustion chamber 28 to the catalytic partial oxidation reaction zone 60. The products of the catalytic partial oxidation reaction zone 60 turn through 180° in the mixing chamber 68 to flow in an axial downstream direction to the aperture 48 in the upstream wall 30 of the tubular combustion chamber 28. The provision of the annular catalytic partial oxidation reaction zone 60 allows this reversal of flow to occur axially through the space within the annular catalytic partial oxidation reaction zone.

The primary fuel and secondary fuel are generally the same hydrocarbon fuel, for example natural gas.

Figure 3:
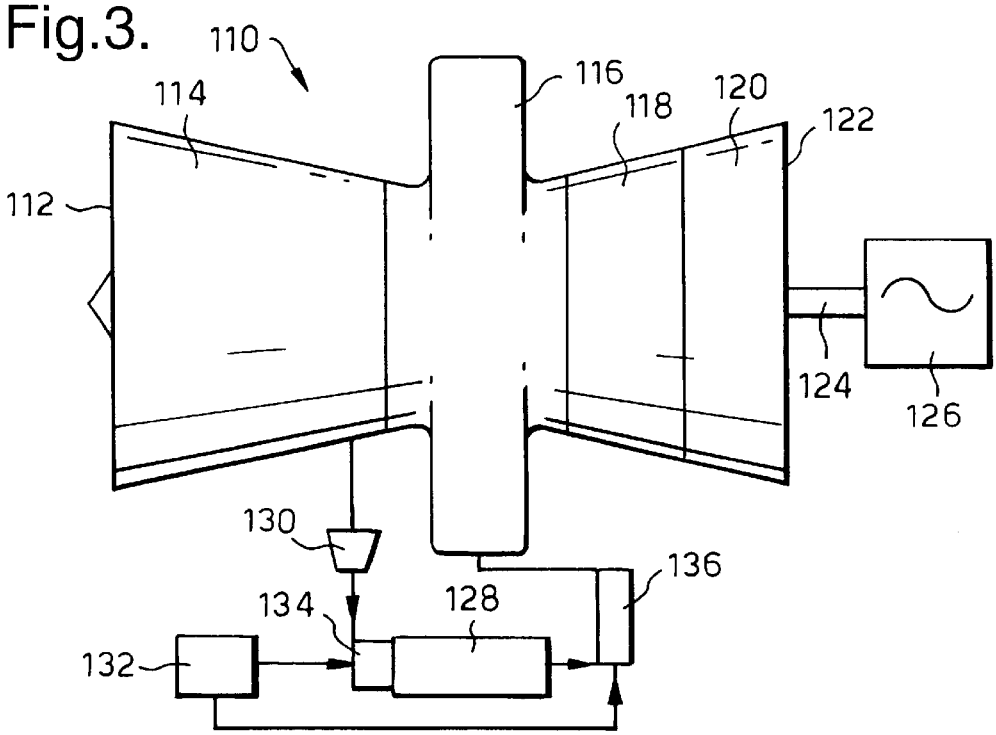
FIG. 3 is a view of another gas turbine engine having a combustion chamber according to the present invention.

The catalytic partial oxidation reaction zone may be arranged remote from the combustion chamber as shown in FIG. 3. The industrial gas turbine engine 110, shown in FIG. 3, comprises in flow series an inlet 112, a compressor section 114, a combustion chamber assembly 116, a turbine section 118, a power turbine section 120 and an exhaust 122. The turbine section 118 is arranged to drive the compressor section 114 via one or more shafts (not shown). The power turbine section 120 is arranged to drive an electrical generator 126 via a shaft 124. However, the power turbine section 120 may be arranged to provide drive for other purposes. The operation of the gas turbine engine is quite conventional and will not be discussed further.

The combustion chamber assembly 116 comprises a plurality of combustion chambers each of which has a primary combustion zone and a secondary combustion zone as described with reference to FIG. 2. A catalytic partial oxidation reaction zone 128 is provided externally of the gas turbine engine 110. A booster compressor 130 is arranged between the compressor assembly 114 and the catalytic partial oxidation reaction zone 128 to further pressurise a portion of the air compressed by the compressor assembly 114 to compensate for pressure losses in the catalytic partial oxidation reaction zone 128. A fuel supply 132 supplies hydrocarbon fuel to an additional fuel and air mixing duct 134 and the booster compressor 130 supplies air to the additional fuel and air mixing duct 134. The fuel and air is mixed in the additional fuel and air mixing duct 134 and is supplied into the catalytic partial oxidation reaction zone 128.

The catalytic partial oxidation reaction zone 128 produces a product gas comprising hydrogen, carbon monoxide, carbon dioxide, water and unreacted hydrocarbon fuel. The product gas is supplied into a mixing duct 136 and additional fuel is supplied from the fuel supply 132 to the mixing duct 136. The product gas and additional fuel is mixed in the mixing duct 136 and supplied to the fuel injectors of the primary fuel and air mixing ducts of the combustion chambers of the combustion chamber assembly 116.

Figure 4:
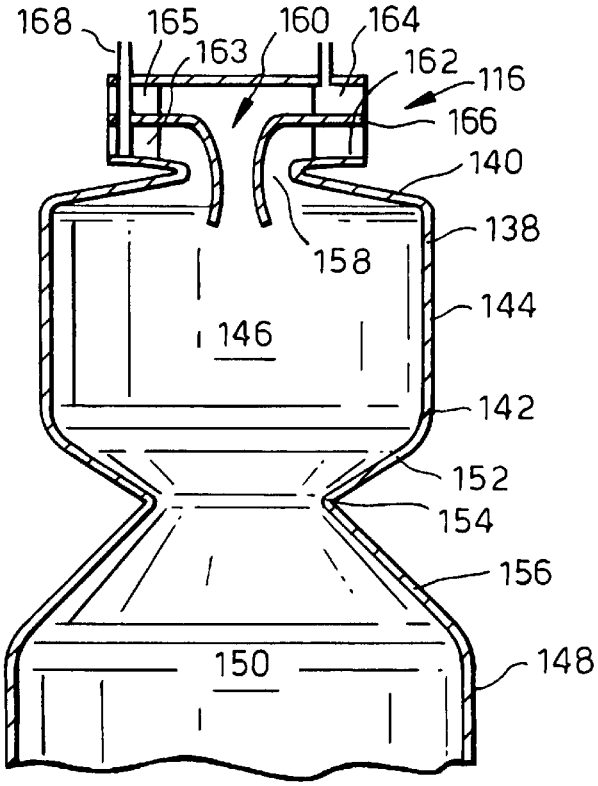
FIG. 4 is an enlarged longitudinal cross-sectional view through the combustion chamber shown in FIG. 3.

The combustion chamber assembly 116 is shown more clearly in FIG. 4, and comprises a plurality of tubular combustion chambers 138. Each of the tubular combustion chambers 138 comprises an upstream wall 140 secured to the upstream end of an annular wall 142. A first, upstream, portion 144 of the annular wall 142 defines a primary combustion zone 146, a second, downstream, portion 148 of the annular wall 142 defines a secondary combustion zone 150. The downstream end of the first portion 144 has a frustoconical portion 152 which reduces in diameter to a throat 154. The second portion 148 of the annular wall 142 has a greater diameter than the first portion 144. A frusto-conical portion 156 interconnects the throat 154 with the upstream end of the second portion 148 of the annular wall 142.

The upstream wall 140 of each tubular combustion chamber 138 has an aperture 158 to allow the supply of air and fuel into the primary combustion zone 146. A first fuel and air mixing duct 160 is arranged to supply a mixture of fuel and air through the aperture 158 into the primary combustion zone 146.

A first radial flow swirler 162 is arranged coaxially with the aperture 158 in the upstream wall 140 and a second radial flow swirler 164 is arranged coaxially with the aperture 158 in the upstream wall 140. The first radial flow swirler 162 is positioned axially downstream, with respect to the axis of the tubular combustion chamber 138, of the second radial flow swirler 164. The first radial flow swirler 162 and the second radial flow swirler 164 comprise a number of swirl vanes 163 and 165 respectively which are connected to and are separated by a common splitter 166. The first radial flow swirler 162 and the second radial flow swirler 164 are arranged to supply air into the first fuel and air mixing duct 160. The first radial flow swirler 162 and the second radial flow swirler 164 are arranged such that they swirl the air in opposite directions.

A plurality of fuel injectors 168 extend axially between the vanes 163 and 165 of the first and second radial flow swirlers 162 and 164 respectively to supply fuel into the primary fuel and air mixing duct 160. The fuel injectors 168 are supplied with fuel by the mixing duct 136.

The presence of the hydrogen in the fuel supplied to the primary combustion zone, and the fact that the fuel is already warm, ensures that the combustion process is more stable than conventional premixed lean burn combustion chambers. Additionally the hydrogen enables the fuel to air ratio to be reduced below that of conventional premixed lean burn combustion chambers, i.e. below the normal weak extinction limit, and hence reducing the maximum combustion temperature and NOx emissions. The more stable combustion allows the emissions of carbon monoxide to be reduced especially when the power is reduced. The proportions of primary fuel supplied to the catalytic partial oxidation reaction zone and the mixing chamber may be varied, to vary the proportion of hydrogen supplied to the primary combustion zone, this may further control the NOx and carbon monoxide emissions. The enhanced stability may reduce the excitation source for the vibrations of the combustion chamber.

Although the catalytic partial oxidation combustion chamber has been described as annular and arranged coaxially with the tubular combustion chamber, other suitable shapes and arrangements may be used. Although only two stages of premixed lean burn combustion have been described, it may be possible to provide three or more stages of premixed lean burn combustion. Although the invention has been described with reference to mixing the reaction products of the catalytic partial oxidation reaction zone with hydrocarbon fuel and air and then to supply this mixture to the primary combustion zone it is equally possible to supply this mixture to the secondary combustion zone or even a tertiary combustion zone. The advantage of supplying the mixture to the secondary combustion zone is that it would again reduce carbon monoxide.

I claim:

1. A combustion chamber comprising at least one combustion zone defined by at least one peripheral wall, at least one first fuel and air mixing duct for supplying fuel and air respectively into the at least one combustion zone, means to supply air into the at least one first fuel and air mixing duct, at least one catalytic partial oxidation reaction zone, at least one additional fuel and air mixing duct for supplying fuel and air respectively into the at least one catalytic partial oxidation reaction zone, means to supply fuel and air into the at least one additional fuel and air mixing duct, the at least one catalytic partial oxidation reaction zone being arranged to produce a product gas comprising a mixture of hydrogen, carbon monoxide, water, carbon dioxide and unreacted fuel, means to supply additional fuel into the product gas produced by the at least one catalytic partial oxidation reaction zone, means to mix the additional fuel and the product gas, and means to supply the product gas and additional fuel into the at least one first fuel and air mixing duct such that the product gas and additional fuel mix with the air in the first fuel and air mixing duct before being supplied into the at least one combustion zone.

2. A combustion chamber as claimed in claim 1 wherein the combustion chamber comprises a primary combustion zone and a secondary combustion zone downstream of the primary combustion zone.

3. A combustion chamber as claimed in claim 2 wherein the at least one first fuel and air mixing duct is arranged to supply fuel and air into the primary combustion zone, and at least one second fuel and air mixing duct is arranged to supply fuel and air respectively to the secondary combustion zone.

4. A combustion chamber as claimed in claim 2 wherein the combustion chamber comprises a tertiary combustion chamber downstream of the secondary combustion zone.

5. A combustion chamber as claimed in claim 4 wherein at least one third fuel and air mixing duct is arranged to supply fuel and air to the tertiary combustion zone.

6. A combustion chamber as claimed in claim 1 wherein an air duct supplies air to the at least one first fuel and air mixing duct, the air duct having means to swirl the air.

7. A combustion chamber as claimed in claim 6 wherein the means to swirl the air comprises a radial flow swirler.

8. A combustion chamber as claimed in claim 1 wherein the at least one additional fuel and air mixing duct comprises an upstream end, means to supply air into the upstream end of the additional fuel and air mixing duct, the means to supply air into the at least one additional fuel and air mixing duct comprises means to swirl the air, means to supply fuel into the upstream end of the additional fuel and air mixing duct, the means to supply fuel into the at least one additional fuel and air mixing duct comprises means to swirl the fuel.

9. A combustion chamber as claimed in claim 8 wherein the means to swirl the air comprises a radial flow swirler and the means to swirl the fuel comprises a radial flow swirler.

10. A combustion chamber as claimed in claim 8 wherein the means to swirl the air and the means to swirl the fuel are arranged to swirl the air and fuel in opposite directions.

11. A combustion chamber as claimed in claim 1 wherein the means to mix the product gas produced by the catalytic partial oxidation reaction zone and the additional fuel comprises means to swirl the additional fuel into the product gas and a duct interconnecting with the first fuel and air mixing duct.

12. A combustion chamber as claimed in claim 1 wherein the combustion chamber is a tubular combustion chamber.

13. A combustion chamber as claimed in claim 12 wherein the first fuel and air mixing duct is annular.

14. A combustion chamber as claimed in claim 12 wherein the additional fuel and air mixing duct is annular.

15. A combustion chamber as claimed in claim 12 wherein the catalytic partial oxidation reaction zone is annular.

16. A combustion chamber as claimed in claim 12 wherein the means to supply the mixture of product gas and additional fuel into the at least one first fuel and air mixing duct comprises an annular duct.

17. A combustion chamber as claimed in claim 12 wherein the additional fuel and air mixing duct is arranged to supply the fuel and air in an axially upstream direction to the catalytic partial oxidation reaction zone, and the means to supply the mixture of product gas and additional fuel is arranged to supply the product gas and additional fuel in an axially downstream direction to the first fuel and air mixing duct.

18. A gas turbine engine comprising a combustion chamber as claimed in claim 1.

* * * * *